US006658129B2

(12) United States Patent
D'Hoogh

(10) Patent No.: US 6,658,129 B2
(45) Date of Patent: Dec. 2, 2003

(54) PASSIVE RADIATOR HAVING MASS ELEMENTS

(75) Inventor: Guido Odilon Maurits D'Hoogh, Dendermonde (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 130 days.

(21) Appl. No.: 09/817,088

(22) Filed: Mar. 26, 2001

(65) Prior Publication Data

US 2001/0026628 A1 Oct. 4, 2001

(30) Foreign Application Priority Data

Mar. 28, 2000 (EP) ..... 00201112.0

(51) Int. Cl.[7] ..... H04R 25/00

(52) U.S. Cl. ..... 381/349; 381/182; 381/346; 181/151

(58) Field of Search ..... 381/162, 182, 381/186, 337, 338, 345, 346, 348, 349, 353, 354, 426, 431; 181/151, 163, 166, 167, 199

(56) References Cited

U.S. PATENT DOCUMENTS 4,284,844 A * 8/1981 Belles ..... 181/151
5,721,786 A * 2/1998 Carrington ..... 381/423
5,812,686 A * 9/1998 Hobelsberger ..... 381/345
5,847,333 A * 12/1998 D'Hoogh ..... 181/171
5,850,460 A * 12/1998 Tanaka et al. ..... 381/182
5,892,184 A 4/1999 D'Hoogh ..... 181/171
5,903,656 A * 5/1999 D'Hoogh ..... 381/333
6,385,327 B1 * 5/2002 D'Hoogh ..... 381/398
6,457,548 B1 * 10/2002 D'Hoogh ..... 181/171

FOREIGN PATENT DOCUMENTS

WO WO007631 A 12/1900
WO WO9746047 12/1997

* cited by examiner

*Primary Examiner*—Curtis Kuntz
*Assistant Examiner*—Suhan Ni
(74) *Attorney, Agent, or Firm*—Edward W. Goodman

(57) ABSTRACT

A passive radiator includes a chassis (11) and a radiator body which is connected to the chassis and which is movable with respect to the chassis along a translation axis (T*). The radiator is capable of displacing comparatively large air volumes. The radiator body includes a central mass element (13*a*) and at least one mass element (13*b*) which is arranged concentrically with respect to the central mass element. The radiator further comprises connection units for movably interconnecting each pair of adjacent mass elements and for movably connecting one of the mass elements to an element (11*a*) of the chassis. Each of the connection units includes two resilient annular connecting rings (5*a*1, 5*a*2; 5*b*1, 5*b*2), which have two adjacent elements which are parts of said elements secured to them. The connecting rings of at least one of the connection units bound a closed chamber (17*a*) containing a gaseous medium in order to counteract undesired noises. The central mass element with its adjacent connection unit as well as each concentrically arranged mass element with its adjacent connecting limb forms a mass spring system, all the mass spring systems thus defined having, at least substantially, the same resonant frequency.

14 Claims, 6 Drawing Sheets

PASSIVE RADIATOR HAVING MASS ELEMENTS

BACKGROUND OF THE INVENTION

1. Field of the Invention

The invention relates to a passive radiator having a chassis and a radiator body flexibly connected to the chassis and movable with respect to the chassis along a translation axis.

2. Description of the Related Art

International Patent Application No. WO-A 97/46047, corresponding to U.S. Pat. No. 5,892,184 (PHN 15.840), discloses a passive radiator which comprises a chassis, a mass element, and a sub-chassis extending between the mass element and the chassis. The mass element is movably fastened to the sub-chassis by means of a first resilient suspension ring, and the sub-chassis is movably fastened to the chassis by means of a second resilient suspension ring. The maximum axial excursion of the mass element is defined by the sum of the maximum axial excursions of each of the suspension rings. It has been found that in the case of uses requiring a comparatively high axial compliance in combination with a comparatively large axial excursion of the mass element, the suspension formed by the suspension rings may exhibit such distortions that undesired noises are produced in operation.

SUMMARY OF THE INVENTION

It is an object of the invention to improve the passive radiator of the type defined in the opening paragraph so as to counteract the generation of undesired noises.

This object is achieved with the passive radiator in accordance with the invention which comprises a chassis and a radiator body connected to said chassis and which is movable with respect to said chassis along a translation axis, the radiator body comprising a central mass element and at least one mass element which is arranged concentrically with respect to the central mass element, connection units being provided for movably interconnecting every two adjacent mass elements and for movably securing one of the mass elements to the element of the chassis, each of said connection units comprising two resilient annular connecting limbs, to which two connecting limbs two adjacent elements which form part of the said elements are secured, the connecting limbs of at least one of the connection units bounding a closed chamber which extends between the elements secured to said units and which is filled with a gaseous medium, the central mass element with its adjacent connection unit, as well as each concentrically arranged mass element with its adjacent connecting limb, forming a mass spring system, all the mass spring systems thus defined having at least substantially the same resonant frequency.

The use of two or more mass elements interconnected by resilient connecting limbs, also referred to as connecting rings, leads to a construction with a multiple suspension in which each mass element present contributes to the total air displacement during use. The connecting limbs are ring-shaped in view of their use. A mass element performs individual movements with respect to an adjacent mass element along the translation axis of the radiator body in operation, which results in displacements with respect to the chassis which are cumulations of individual movements. Comparatively large displacements of mass elements can be realized in this manner, so that considerable volume displacements can be achieved with a comparatively small radiator body. To counteract parasitic resonances and, as a consequence, the generation of undesired noises during use, the mass spring systems, present in the passive radiator according to the invention as defined above, have the same, or practically the same, resonance frequency. As a result of the use of one or more closed, i.e., impervious, chambers, translational movements of the radiator body produce pressure variations in the gaseous medium present between the connecting limbs of one or more connecting units. In the case of deflecting translational movements of the radiator body, these pressure variations are pressure rises, which have a favorable effect on the behavior of the suspension, particularly on the connecting limbs of the respective connecting unit or units. As a matter fact, these pressure rises result in pressure being exerted on the respective connecting limbs, which pressure issues from the closed chamber or chambers and prevents the connecting limbs from behaving in an unstable manner, such as flapping, fluttering or buckling, and thus producing undesired noises. This measure furthermore has the advantage that thin connecting limbs can be used, which enables a high axial compliance, i.e., a low stiffness, of the suspension formed by the connecting limbs to be achieved in the directions of translation of the radiator body. Decisive factors for the overall axial compliance of the whole arrangement are, particularly, the compliance of the medium in the closed chamber or chambers, and the resistance to deformation of the suspension. As the gaseous medium, a gas, air or another gas mixture may be used.

An embodiment of the passive radiator in accordance with the invention is characterized in that the connection units allow mainly movements of the mass elements along the translation axis of the radiator body, and counteract other movements. In this embodiment, it is prevented that the mass elements perform undesired tilting movements with respect to one another during operation, which tilting movements could lead to distortions in the sound reproduction. The annular connecting limbs used may be made from resilient materials which are known per se, such as, polyurethane or rubber, and preferably have a folded or corrugated structure.

An embodiment of the radiator in accordance with the invention is characterized in that a sealed chamber extends at least between the connecting limbs of the connection unit which adjoins the central mass element.

The embodiment of the radiator described above is preferably characterized in that the central mass element has a projection which extends to a location between the connecting limbs of the connection unit which adjoins the central mass element. The use of this characteristic feature results in a reduction of the closed chamber, which leads to greater pressure variations when the radiator body moves. An advantage of this that very thin connecting limbs can be used, preferably membranous limbs. Preferably, the projection is annular.

An embodiment of the radiator in accordance with the invention is characterized in that the sealed chamber contains a damping means for damping movements of the gaseous medium. The use of this characteristic feature enables the mechanical Q factor of the mass-spring systems to be reduced, as a result of which, any mutual resonances are damped out very effectively.

In the embodiment described above, the damping means preferably comprises an annular body of a porous material, for example, a cellular material, such as, a polyurethane foam. Such a material has a structure of small open cells. In operation, i.e., while the radiator body performs a translation, a gaseous medium present in the closed chamber flows through the cellular structure. This flow presents a mechanical resistance to translational movements of the radiator body with respect to its environment.

A practical embodiment of the radiator in accordance with the invention is characterized in that the annular body of a porous material forms part of the central mass element of the radiator body. The annular body may then be a part secured to the central mass element. The central mass element may be provided with a tuning mass, for which purpose a recess or cavity may be provided.

An embodiment of the radiator in accordance with the invention is characterized in that the number of mass elements is two, three or four. Although it is possible to use more mass elements, it has been found that a construction using two, three or four mass elements is satisfactory and can well be realized in practice in order to obtain a reliable radiator which is free from undesired noises and has a large excursion.

An embodiment of the radiator in accordance with the invention is characterized in that the shapes of the connecting limbs are identical to one another. This embodiment is to be preferred if it is an object to give each mass element the same maximum axial excursion with respect to its adjacent mass element or adjacent mass elements. In a practical embodiment, the connecting limbs may be, for example, omega-shaped. Any further connecting limbs are preferably arranged mirror-inverted positions with respect to each other for reasons of symmetry, so as to prevent asymmetry in the excursions and amplitudes of the mass elements.

An embodiment of the radiator according to the invention is characterized in that at least a number of the connecting limbs are of mutually different sizes, said sizes increasing in a direction away from the central mass element. By this measure, it is achieved that in relative terms, i.e., relative to its adjacent centrally disposed or more centrally disposed mass element, an annular mass element can perform a greater maximum relative displacement. An advantage of this configuration is that the connection units are utilized in an optimum manner without the deflections causing any undesired deformations of the connecting limbs.

The invention further relates to a loudspeaker system comprising an enclosure or cabinet which accommodates an electrodynamic loudspeaker and a passive radiator. The loudspeaker may be of any type which is known per se. The passive radiator present in the loudspeaker system according to the invention is constructed as defined above. The connection units of the passive radiator in the system according to the invention, allow well-defined mutual displacements of the mass elements under the influence of pressure variations in the enclosure, these displacements resulting in comparatively large air displacements, thereby enabling a comparatively high sound pressure to be achieved. Under the influence of pressure variations in the enclosure, the various connection units in such a system allow excursions which are fully adapted to the total moving mass of the radiator and the tuning frequency, the so-called Helmholtz resonance, of the system. For the above-mentioned reason, the resonant frequency of the mass spring systems that have been provided is preferably equal to the Helmholtz frequency of the enclosure including the loudspeaker and passive radiator, in the case that the system in accordance with the invention has 2 mass elements.

The invention further relates to an apparatus for presenting audible and, at option, visible information, the apparatus in accordance with the invention including the loudspeaker system in accordance with the invention. Such an apparatus is, for example, an audio-video or multi-media apparatus.

BRIEF DESCRIPTION OF THE DRAWINGS

The invention will now be described in more detail by way of example with reference to the drawings, in which.

DESCRIPTION OF THE PREFERRED EMBODIMENTS

Figure 1:
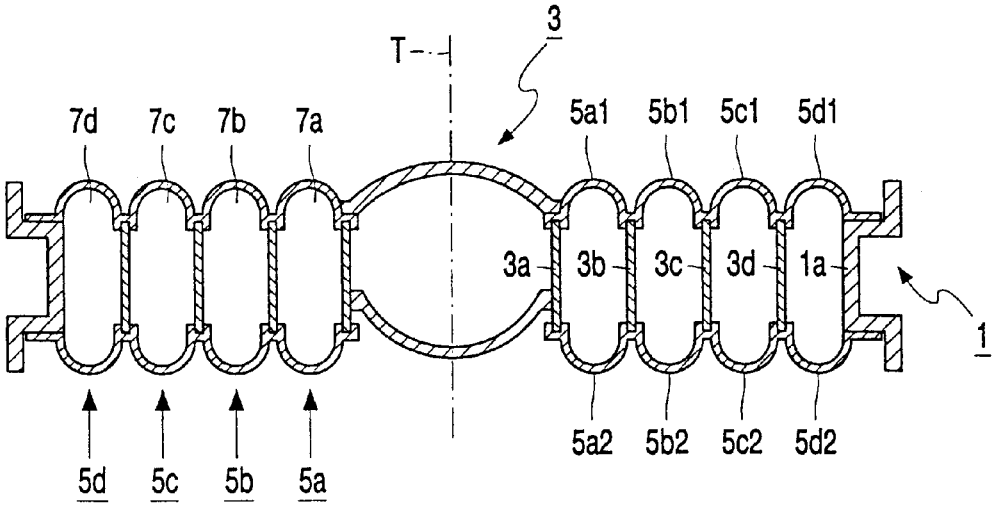
FIG. 1 is a diagrammatic longitudinal sectional view which shows a first embodiment of the passive radiator in accordance with the invention.

The passive radiator, in accordance with the invention shown in FIG. 1, is suitable for use in a bass reflex loudspeaker system. The radiator comprises a chassis 1, a radiator body 3 movable relative to the chassis 1 along a translation axis T, and connection means for flexibly connecting the radiator body 3 to an element la of the chassis 1. In the present example, the element 1*a* is cylindrical. The radiator body 3 in the present example comprises a central mass element 3*a* and three mass elements 3*b*, 3*c* and 3*d* which are arranged concentrically with respect to the central mass element 3*a*. The central mass element 3*a* in the present example is constructed as a cylinder having an imperforate cylindrical wall closed with two convex end faces. The other mass elements 3*b*, 3*c* and 3*d* in the present example are also cylinders but have open end faces. The cylinders may be have imperforate cylindrical walls or more or less open cylindrical walls. In the present example said connection means comprise four connection units 5*a*, 5*b*, 5*c* and 5*d*. The three connection units 5*a*, 5*b* and 5*c* serve for connecting the two respective adjacent mass elements 3*a*/3*b*, 3*b*/3*c*, and 3*c*/3*d*, so as to be movable relative to one another. The connection unit 5*d* serves for movably connecting the mass element 3*d* to the element 1*a* of the chassis 1. In the present example, each of the connection units 5*a*, 5*b*, 5*c* and 5*d* is formed by two annular connecting limbs 5*a*1/5*a*2, 5*b*1/5*b*2, 5*c*1/5*c*2, and 5*d*1/5*d*2, respectively. In the present example, these connecting limbs are of omega-shaped cross-section and are made of rubber. At their edges the annular connecting limbs are connected to the mass elements 3*a*, 3*b*, 3*c* and 3*d* and to the element 1*a* of the chassis 1, as applicable, by fixing means which are known per se, such as, an adhesive, and, on account of their shapes and material properties. The annular connecting limbs have a behavior such that during use, mainly movements of the mass elements 3*a*, 3*b*, 3*c* and 3*d* along the translation axis T are admitted, while undesirable tilting movements of the mass elements are counteracted. In the present example, the connecting limbs are identical to one another, wave crests of two facing connecting limbs 5*a*1/5*a*2, 5*b*1/5*b*2, 5*c*1/5*c*2, and 5*d*1/5*d*2 being remote from each other so as to obtain a symmetrical suspension arrangement.

The passive radiator in accordance with the invention, as shown in FIG. 1, has four mass spring systems which are independent of one another. These mass spring systems are formed by the mass element 3*a* with its adjacent connection unit 5*a* formed by the adjacent connecting limbs 5*a*1 and 5*a*2; the mass element 3*b* with its adjacent connecting limbs 5*a*1/5*a*2 and 5*b*1/5*b*2; the mass element 3*c* with its adjacent connecting limbs 5*b*1/5*b*2 and 5*c*1/5*c*2; and the mass element 3*d* with its adjacent connecting limbs 5*c*1/5*c*2 and 5*d*1/5*d*2. One of the characteristic features of the embodiment shown is that the mass spring systems all have the same, or substantially the same, resonant frequency so as to ensure that the mass elements 3*a*, 3*b*, 3*c* and 3*d* always move in phase during operation. The embodiment of the passive radiator in accordance with the invention as shown in FIG. 1 has four concentric continuous chambers 7*a*, 7*b*, 7*c* and 7*d* which are coaxial with the translation axis T and which are, respectively, bounded by the central mass element 3*a*, the connecting limbs 5*a*1, 4*a*2 and the mass element 3*b*; the mass element 3*b*, the connecting limbs 5*b*1, 5*b*2 and the mass element 3*c*; the mass element 3*c*, the connecting limbs 5*c*1, 5*c*2 and the mass element 3*d*; the mass element 3*d*, the connecting limbs 5*d*, 5*d*2 and the element 1*a* of the chassis 1. Of the chambers 7*a*, 7*b*, 7*c* and 7*d*, the chamber 7*a* is closed, or sealed, and filled with air of which the pressure in the position shown, i.e., the rest position, of the radiator corresponds to the atmospheric pressure. The pressure may alternatively be slightly higher than the atmospheric pressure. The measures that have been taken ensure a reliable operation of the passive radiator, the maximum displacement of the central mass element 3*a* from its rest position being the sum of the maximum excursions allowed by the individual connection units 5*a*, 5*b*, 5*c* and 5*d*. It will be obvious that the maximum displacement of the mass element 3*b* is the sum of the maximum excursions of the individual connection units 5*b*, 5*c* and 5*d*; the maximum displacement of the mass element 3*c* is the sum of the maximum excursions of the connection units 5*c*, and 5*d*; and the maximum displacement of the mass element 3*d* corresponds to the maximum excursion of the connection unit 5*d*. Large air displacements are possible as a result of the comparatively large maximum displacement of the radiator body 3 obtained here.

Figure 2:
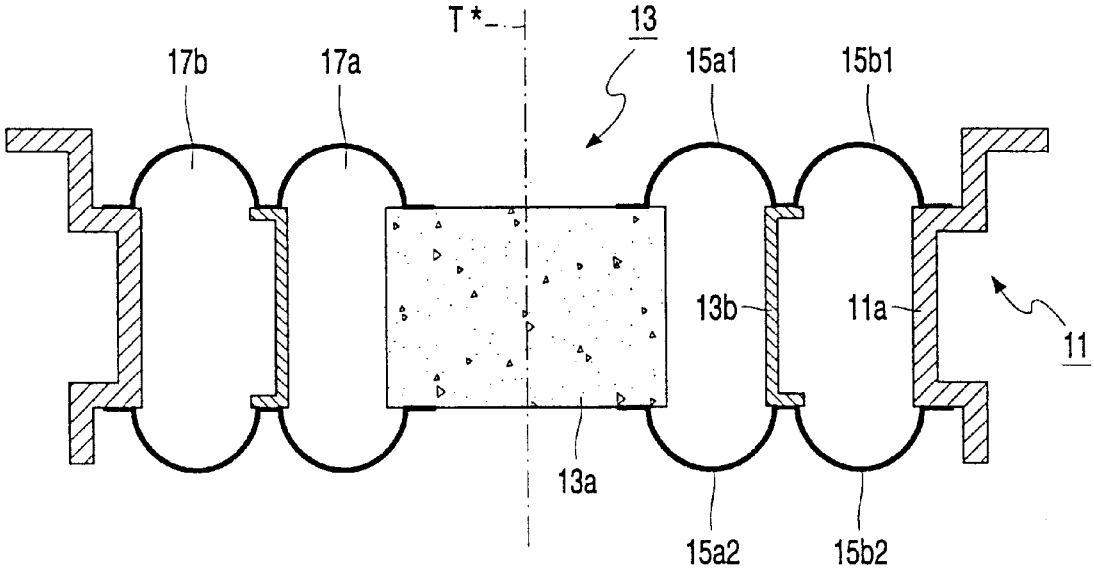
FIG. 2 is a diagrammatic longitudinal sectional view which shows a second embodiment of the passive radiator, in accordance with the invention, in a rest condition.

The easy-to-realize and, consequently, practical passive radiator according to the invention shown in FIG. 2 has a chassis 11 and a radiator body 13 which comprises two mass elements. The radiator body 13 is movable relative to the chassis 11 along a translation axis T*. The radiator body 13 has a cylindrical central mass element 13*a* which is circumferentially closed and a cylindrical mass element 13*b* which is circumferentially closed. The chassis 11 has a cylindrical element 11*a*. The elements 11*a*, 13*a* and 13*b* all lie in one zone and are arranged coaxially with one another, the central axis of the central mass element 13*a* being coincident with the translation axis T*. The mass elements 13*a* and 13*b* are mechanically interconnected by means of a pair of resilient annular connecting limbs 15*a*1 and 15*a*2. The mass element 13*b* is also mechanically connected to the element 11*a* of the chassis 11 by means of a pair of resilient annular connecting limbs 15*b*1, 15*b*2. The configuration of mass elements 13*a* and 13*b* and connecting limbs 15*a*1, 15*a*2 and 15*b*1, 15*b*2 as used in this embodiment implies that there are two mass spring systems. These mass spring systems are formed by the mass element 13*a* and the pair of connecting limbs 15*a*1, 15*a*2; by the mass element 13*b* and the connecting limbs 15*a*1, 15*a*2 and 15*b*1, 15*b*2. These mass spring systems have the same resonant frequency (natural frequency). The connecting limbs 15*a*1, 15*a*2 and 15*b*1 are made of rubber or another air-tight material and are all flexible and compliant in directions parallel to the translation axis T* and offer sufficient resistance to lateral deformations. In the present embodiment, the space bounded by the central mass element 13*a*, the mass element 13*b*, both made of, for example, a hard plastic, and the connecting limbs 15*a*1 and 15*a*2 connected to the elements 13*a* and 13*b* takes the form of a sealed chamber 17*a*, in which a volume of air is present. If desired, the space bounded by the mass element 13*b*, the element 11*a* and the connecting limbs 15*b*1 and 15*b*2 connected to these two elements may also take the form of a sealed chamber 17*b*, in which case the element should be circumferentially closed.

Figure 3:
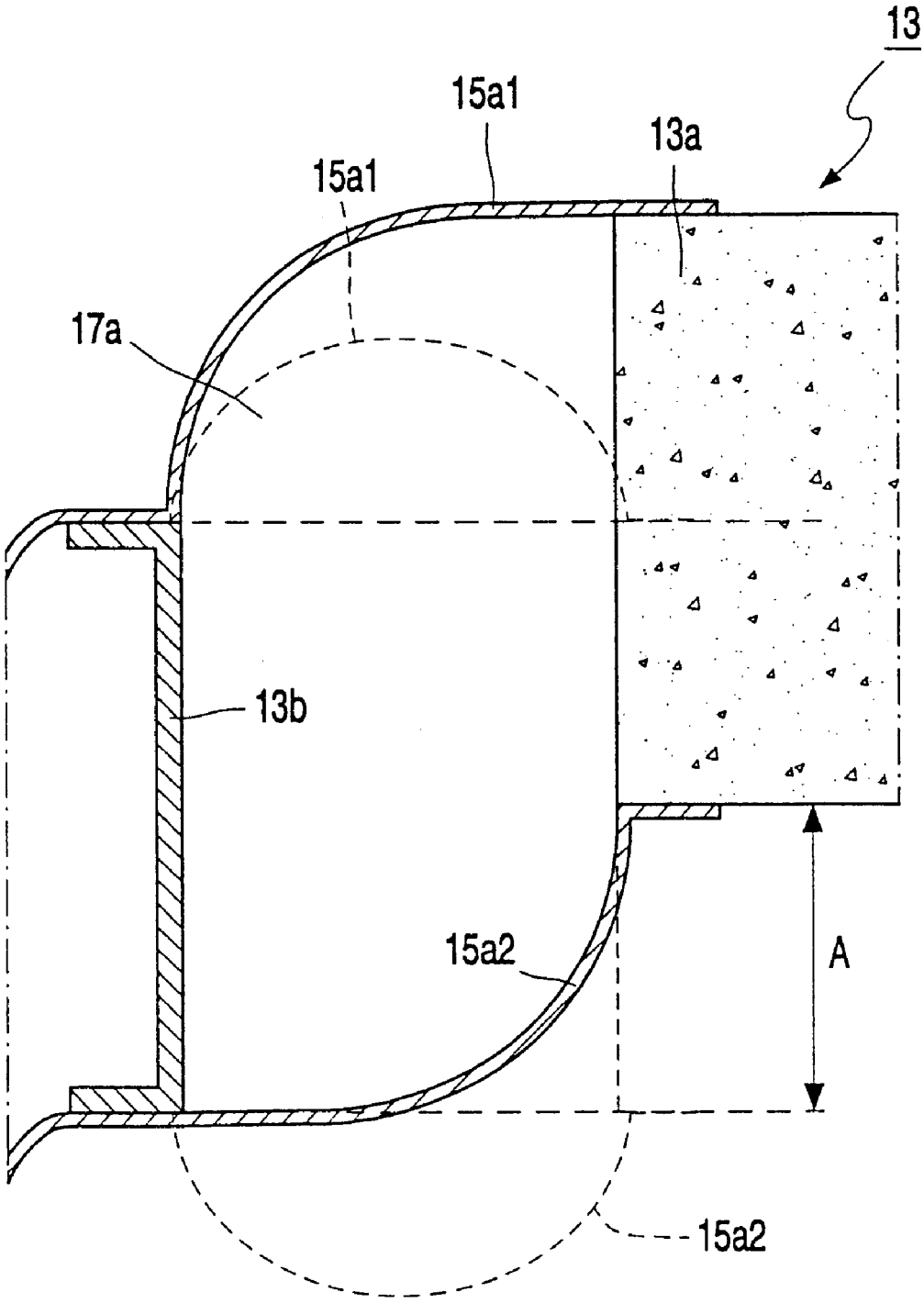
FIG. 3 is a diagrammatic longitudinal sectional view which shows the second embodiment of the passive radiator, in accordance with the invention, in an operating condition.

The embodiment shown in FIG. 2 is shown in its rest position. FIG. 3 shows a part of this embodiment but now the radiator body 13 has performed a movement along the translation axis T* out of the rest position under the influence of external pressure variations, the central mass element 13*a* having an excursion A with respect to mass element 13*b*. The shape of the connecting limbs 15*a*1 and 15*a*2 in the rest position of the radiator is shown in broken lines in FIG. 3. In the operating position of the radiator, the volume of the sealed chamber 17*a*, as is also illustrated in FIG. 3, is smaller than in the rest position. This means that there has been a rise in air pressure during the movement of the mass element 13*a* with respect to the mass element 13*b*. As stated hereinbefore, such a rise in pressure has a favorable effect on the behavior of the connecting limbs 15*a*1 and 15*a*2, particularly as regards the maintenance of their bent shapes. As a result of the measures taken, the connecting limbs 15*a*1 and 15*a*2 can be surprisingly thin. In the present example, the thickness is 0.3 mm.

In the following description of further embodiments, the same reference numerals as used in the description of the embodiment shown in FIG. 2 will be used for like parts in the various embodiments.

Figure 4:
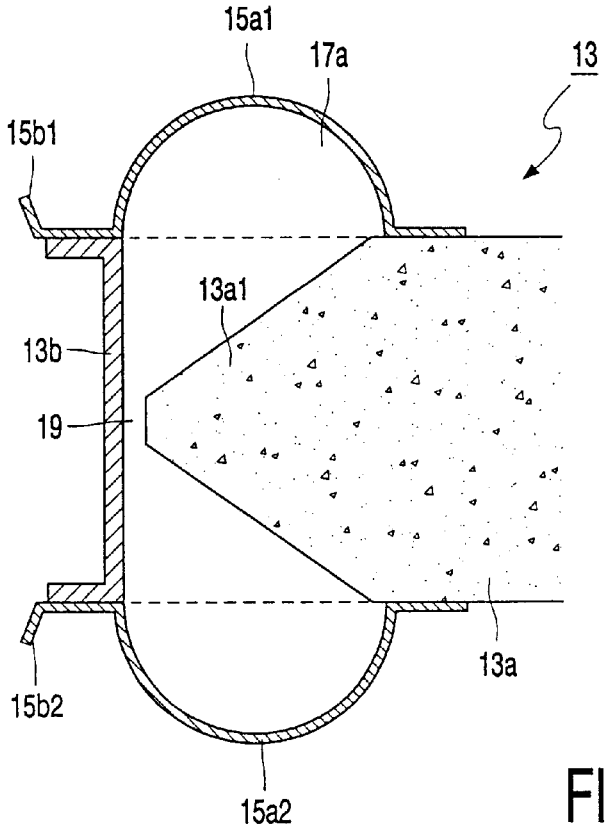
FIG. 4 is a diagrammatic longitudinal sectional view which shows a third embodiment of the passive radiator in accordance with the invention.

In the embodiment of the radiator in accordance with the invention shown in FIG. 4 the central mass element 13*a*, which in the present embodiment is made of a hard plastic, has a radially projecting annular projection 13*a*1 which surrounds the mass element 13*a* concentrically. The annular projection 13*a*1, which is integral with the mass element 13*a* and has inherently imperforate walls, extends into the air-filled sealed chamber 17*a*. The presence of the projection 13*a*1 provides a substantial reduction of the volume of the chamber 17*a*, as a result of which comparatively large pressure variations can occur during axial excursions of the mass element 13*a* with respect to the mass element 13*b*. With the mass element 13*b* in the sealed chamber 17*a*, the projection 13*a* defines a narrow passage 19, which has a damping effect on the air streams produced in the chamber 17*a* during movements of the radiator body 13 with respect to the chassis 1. The annular projection 13*a*1 preferably has trapezoidal longitudinal section which decreases in a radially outward direction.

Figure 5:
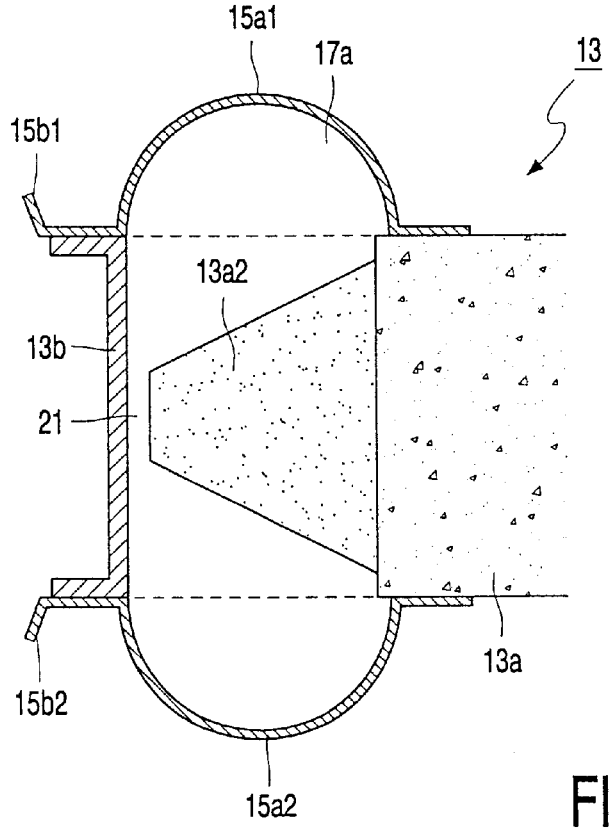
FIG. 5 is a diagrammatic longitudinal sectional view which shows a fourth embodiment of the passive radiator in accordance with the invention.

The embodiment shown in FIG. 5 has a central mass element 13*a* to which an annular body 13*a*2 of a porous material, in the present example a polyurethane foam, is secured. The annular body 13*a*2 is disposed in the sealed chamber 17*a* and, in operation, it has a damping effect on air streams generated in the chamber 17*a*. In a longitudinal sectional view, the porous body 13*a*2 is tooth-shaped and has a top facing the adjacent mass element 13*b*. Preferably, a narrow annular gap 21 is formed between the body 13*a* and the mass element 13*b*.

Figure 6:
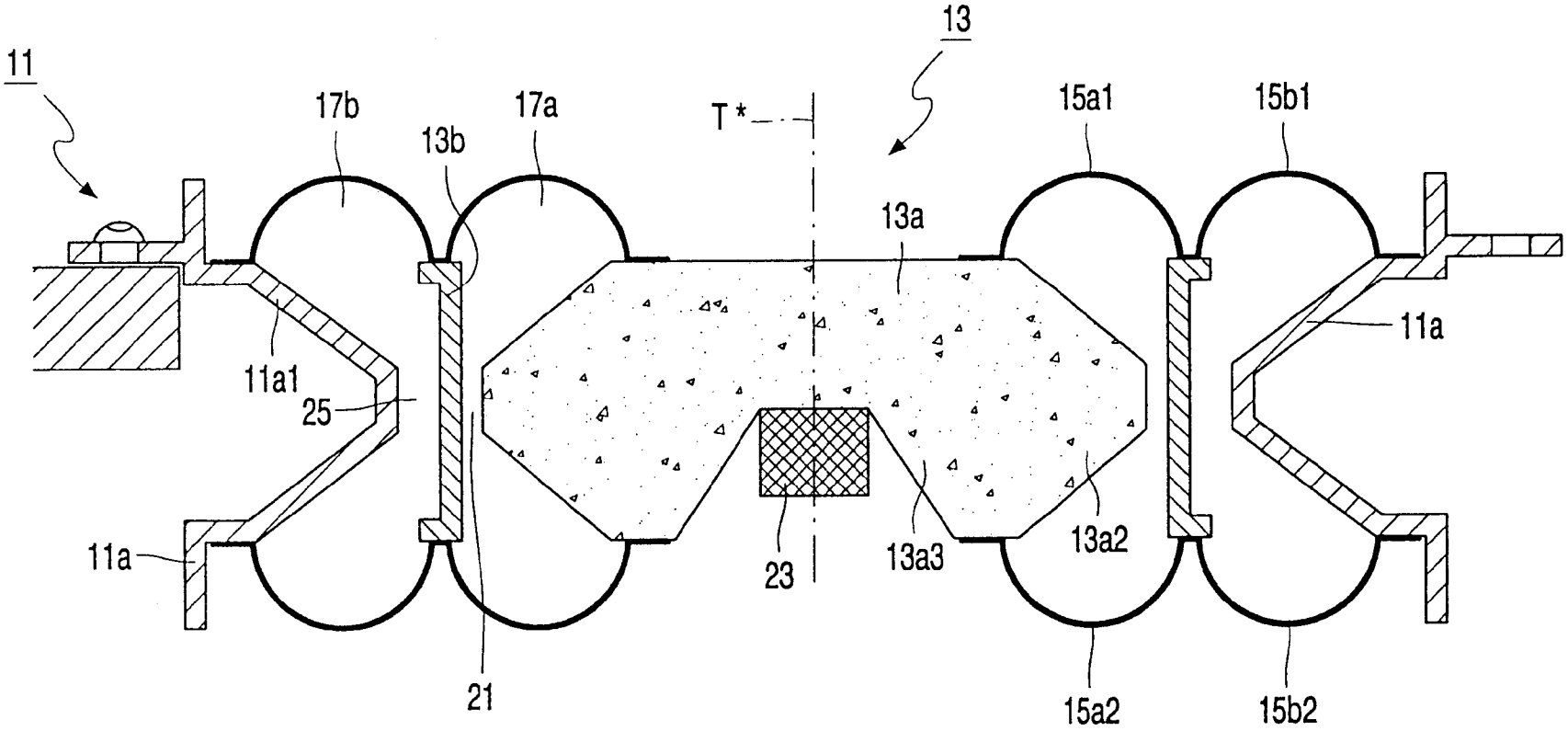
FIG. 6 is a diagrammatic longitudinal sectional view which shows a fifth embodiment of the passive radiator in accordance with the invention.

FIG. 6 shows an embodiment of the passive radiator in accordance with the invention having two sealed chambers 17*a* and 17*b*. The central mass element 13*a* has a central base 13*a*3 and an annular body 13*a*2 which extends into the sealed chamber 17*a*, the base 13*a*3 and the body 13*a*2 forming an integral body having imperforate walls. In a central area the mass element 13*a* has a cavity for receiving a tuning mass 23. In the present example, the element 11*a* of the chassis 11 has an annular inward projection 11*a*1 in order to reduce the volume of the chamber 17*b*. A passage 25 is situated between the projection 11*a*1 and the facing mass element 13*b*.

Figure 7:
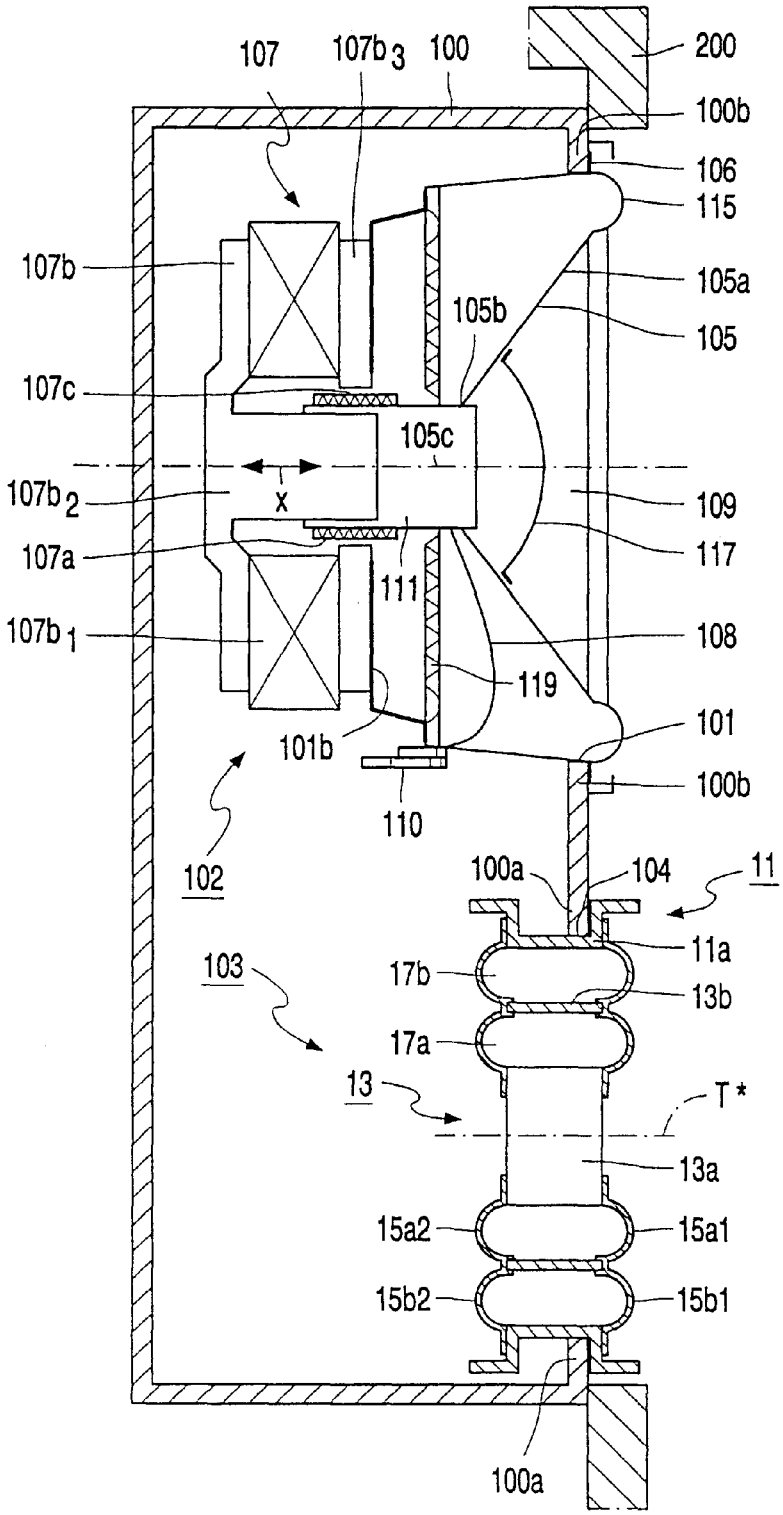
FIG. 7 is a diagrammatic longitudinal sectional view which shows an embodiment of the loudspeaker system in accordance with the invention.

The loudspeaker system in accordance with the invention shown in FIG. 7, i.e., a bass reflex system, comprises an enclosure or acoustic box 100 which accommodates the passive radiator in accordance with the invention, in the present example, a radiator in accordance with the embodiment shown in FIG. 2 and bearing the reference numeral 103, and an electrodynamic loudspeaker 102. The loudspeaker 102 drives the radiator 103 during operation, the loudspeaker and the radiator in this example together providing the sound production in the low-frequency range of the sound spectrum. The system is, consequently, a subwoofer device. The enclosure 100 of the system has a first opening 104 through which the chassis 11 of the passive radiator 103 extends, and a second opening 106 through which a chassis 101 of the loudspeaker 102 extends. The chassis 11 and the chassis 101 are secured to the edge portions 100*a* and 100*b* of the enclosure which surround the openings 104 and 106, respectively.

For a more detailed description of the passive radiator 103, reference is made to the passages in the present document which relate to the radiator shown in FIG. 2, and it is to be noted that the resonant frequency of the mass spring systems provided in the radiator 103 is equal to the Helmholtz resonance of the system.

The loudspeaker 102 used in the system shown comprises a conical diaphragm 105 and an electromagnetic actuator 107. In the present example, a dust cap 117 is present in the diaphragm 105. The diaphragm 105 has a front part 105*a* with an opening 109 and a rear part 105*b* with a tubular central element 111. The element 111 carries a first actuator part 107*a* of the actuator 107, which part takes the form of a coil in the present example. The coil 107*a* is electrically connected to terminals 110 disposed on the chassis 101 via electrical conductors 108. The actuator 107 further comprises a second actuator part 107*b*, which in the present example includes an annular magnet 107*b*1, a yoke part 107*b*2, and a yoke part 107*b*3 secured to a chassis part 101*b* of the chassis 101. An air gap 107*c*, in which the coil 107*a* extends, is formed between the yoke parts 107*b*2 and 107*b*3. When the actuator is energized, the coil 107*a*, and thus the diaphragm 105, will perform an axial excursion along a diaphragm axis 105*c* in either of the axial directions indicated by a double arrow X.

The loudspeaker 102 has been provided with a flexible connecting limb 115, which connects the front part 105*a* of the diaphragm 105 to the chassis 101. In the present example, the flexible connecting limb 115 is constructed as an annular element of omega-shaped cross-section. The connecting limb 115, which is made, for example, of polyurethane, may be connected to the diaphragm 105 and the chassis 101 by means of an adhesive joint.

In the present example, the loudspeaker 102 further includes a flexible centering element 119 in the form of a centering disc having a concentric corrugation pattern and made of a suitable material, such as, a textile fabric, which connects the chassis 101 to the back part 105*b*, in particular to the central element 111 thereof. The centering element 119 and the connecting limbs 113 and 115 are suspension means which are comparatively slack and flexible in axial directions indicated by the arrow X but which are comparatively stiff in other directions, as a result of which, the diaphragm 105 with the coil 107*a* is capable of performing well-defined axial excursions with respect to the chassis 101. Obviously, another loudspeaker than the loudspeaker shown may be used, such as, a loudspeaker element with a multiply suspended vibration system.

Figure 8:
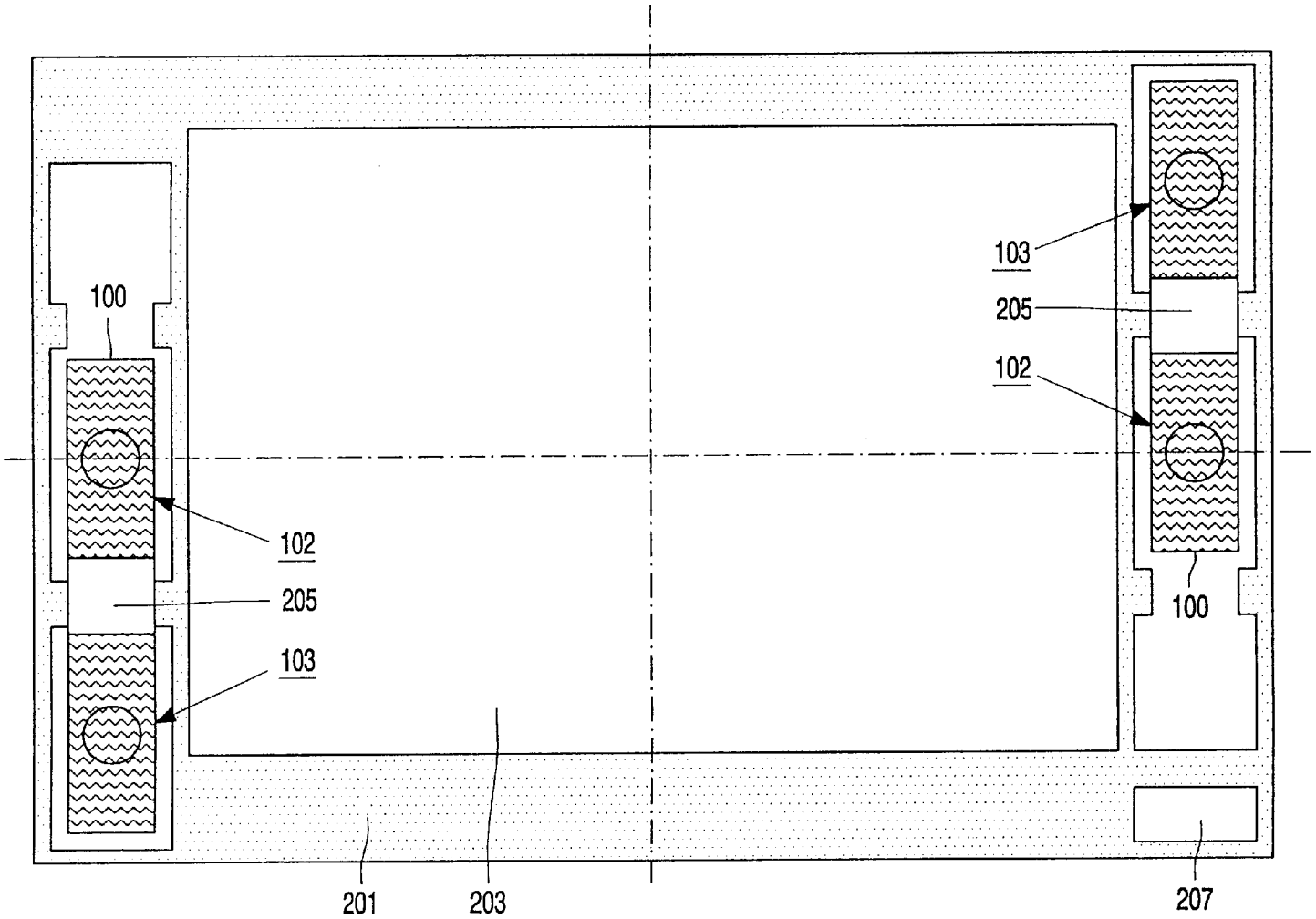
FIG. 8 is a diagrammatic front view which shows an embodiment of the apparatus in accordance with the invention.

The apparatus in accordance with the invention shown in FIG. 8 is a flat-panel multimedia TV set. The apparatus has a cabinet 201 which accommodates a display screen 203 and two loudspeaker systems in accordance with the invention. The cabinet 201 has an on/off-switch unit 207 at its front side. The loudspeaker systems in the present example correspond to the loudspeaker system as shown in FIG. 7 and bear the reference numeral 205 in FIG. 8. Each loudspeaker system 205 consequently has an enclosure 100 with a loudspeaker 102 and a passive radiator 103 in accordance with the invention. Instead of the apparatus shown, the apparatus in accordance with the invention may alternatively be a conventional TV set, a monitor, or a piece of audio equipment. Furthermore, the radiator used in the apparatus may be constructed as shown in FIGS. 1, 3, 4, 5 or 6 or in some other manner within the scope of the invention, and a loudspeaker different from the loudspeaker shown in FIG. 7 may be used. Furthermore, the invention is not limited to the embodiments of the passive radiator shown in the Figures. For example, instead of two, three or four mass elements, more than four mass elements may be used, and instead of omega-shaped connecting limbs sinusoidal or differently shaped suitable connecting limbs may be used.

What is claimed is:

1. A passive radiator comprising a chassis and a radiator body connected to said chassis, said radiator boding being movable with respect to said chassis along a translation axis, the radiator body comprising a central mass element and at least one further mass element arranged concentrically with respect to the central mass element, connection units being provided for movably interconnecting every two adjacent mass elements of the central mass element and the at least one further mass element, and for movably securing one of the mass elements to an element of the chassis, each of said connection units comprising two resilient annular connecting limbs secured to two adjacent mass elements of the central mass element and the at least one further mass element, the connecting limbs of at least one of the connection units bounding a closed chamber extending between the two adjacent mass elements secured to said units, said closed chamber being filled with a gaseous medium, the central mass element with the connection unit secured thereto, as well as each concentrically arranged further mass element with the connection unit secured thereto, forming a mass spring system, all of the mass spring systems having at least substantially the same resonant frequency.

2. The passive radiator as claimed in claim 1, in which the connection units allow mainly movements of the mass elements along the translation axis of the radiator body and counteract other movements of the mass elements.

3. The passive radiator as claimed in claim 1, in which a sealed chamber extends at least between the connecting limbs of the connection unit adjoining the central mass element.

4. The passive radiator as claimed in claim 3, in which the central mass element has a projection extending to a location between the connecting limbs of the connection unit adjoining the central mass element.

5. The passive radiator as claimed in claim 1, in which a sealed chamber extends at least between the connecting limbs of the connection unit adjoining the element of the chassis.

6. The passive radiator as claimed in claim 5, in which the element of the chassis has a projection extending to a location between the connecting limbs of the connection unit adjoining the element of the chassis.

7. The passive radiator as claimed in claim 1, in which the closed chamber contains a damping means for damping movements of the gaseous medium.

8. The passive radiator as claimed in claim 7, in which the damping means comprises an annular body of a porous material.

9. The passive radiator as claimed in claim 8, in which the annular body of a porous material forms part of the central mass element.

10. The passive radiator as claimed in claim 1, in which the number of mass elements is two, three or four.

11. The passive radiator as claimed in claim 1, in which the shapes of the connecting limbs are identical to one another.

12. The passive radiator as claimed in claim 1, characterized in that at least a number of the connecting limbs are of mutually different sizes, said sizes increasing in a direction away from the central mass element.

13. A loudspeaker system comprising an enclosure accommodating an electrodynamic loudspeaker and a passive radiator, said passive radiator comprising a chassis and a radiator body connected to said chassis, said radiator boding being movable with respect to said chassis along a translation axis, the radiator body comprising a central mass element and at least one further mass element arranged concentrically with respect to the central mass element, connection units being provided for movably interconnecting every two adjacent mass elements of the central mass element and the at least one further mass element, and for movably securing one of the mass elements to an element of the chassis, each of said connection units comprising two resilient annular connecting limbs secured to two adjacent mass elements of the central mass element and the at least one further mass element, the connecting limbs of at least one of the connection units bounding a closed chamber extending between the two adjacent mass elements secured to said units, said closed chamber being filled with a gaseous medium, the central mass element with the connection unit secured thereto, as well as each concentrically arranged further mass element with the connection unit secured thereto, forming a mass spring system, all of the mass spring systems having at least substantially the same resonant frequency.

14. The loudspeaker system as claimed in claim 13, in which the number of mass elements is two, and in which the resonant frequency of the mass spring systems is equal to the Helmholtz frequency of the enclosure including the loudspeaker and the passive radiator.

* * * * *